US011515133B2

(12) United States Patent
Rubenstein et al.

(10) Patent No.: US 11,515,133 B2
(45) Date of Patent: Nov. 29, 2022

(54) METHOD OF IMPROVING A MASS SPECTROMETER, MODULE FOR IMPROVING A MASS SPECTROMETER AND AN IMPROVED MASS SPECTROMETER

(71) Applicant: Government of the United States, as represented by the Secretary of the Air Force, Wright-Patterson AFB, OH (US)

(72) Inventors: Mitchell H Rubenstein, Beavercreek, OH (US); Anthony V Qualley, Washington Township, OH (US); Benjamin A Clapp, Huber Heights, OH (US)

(73) Assignee: United States of America as represented by the Secretary of the Air Force, Wright-Patterson AFB, OH (US)

( * ) Notice: Subject to any disclaimer, the term of this patent is extended or adjusted under 35 U.S.C. 154(b) by 183 days.

(21) Appl. No.: 17/022,245

(22) Filed: Sep. 16, 2020

(65) Prior Publication Data

US 2022/0084801 A1 Mar. 17, 2022

(51) Int. Cl.
*H01J 49/00* (2006.01)

(52) U.S. Cl.
CPC ..... *H01J 49/0009* (2013.01); *H01J 49/0036* (2013.01)

(58) Field of Classification Search
CPC ..... H01J 49/0009; H01J 49/0036
See application file for complete search history.

(56) References Cited

PUBLICATIONS

Rubenstein, M.; Fullerton, K.; Grigsby, C.; Ott, D.; Hughes G.; Fisher, G.; Improved Field Results Using Thermal Desorption with a 3-Point Stable- Isotope Curve Incorporated Prior to Sampling, Air Force Research Labs Presentation, 2017.

*Primary Examiner* — Roy Y Yi
*Assistant Examiner* — Geoffrey T Evans
(74) *Attorney, Agent, or Firm* — AFMCLO/JAZ; James F. McBride

(57) ABSTRACT

The present invention relates to a method of improving a mass spectrometer, a module for improving a mass spectrometer and an improved mass spectrometer. The aforementioned method employs a calibration correction module that calibrates the mass spectrometer so timely, more precise and accurate data can be obtained. In particular, real time, accurate mass determinations of low analyte quantity samples can be obtained.

2 Claims, No Drawings

METHOD OF IMPROVING A MASS SPECTROMETER, MODULE FOR IMPROVING A MASS SPECTROMETER AND AN IMPROVED MASS SPECTROMETER

RIGHTS OF THE GOVERNMENT

The invention described herein may be manufactured and used by or for the Government of the United States for all governmental purposes without the payment of any royalty.

FIELD OF THE INVENTION

The present invention relates to a method of improving a mass spectrometer, a module for improving a mass spectrometer and an improved mass spectrometer.

BACKGROUND OF THE INVENTION

Current mass spectrometers are used to determine the mass of an analyte in a sample. Unfortunately, the data analysis associated with a mass spectrometric run is time consuming, inefficient and fraught with instrumental variability. Thus, the timing between the sample run and the receipt of actionable data may be unacceptable. For example, in the case of the contamination of an area with an undesirable agent such as a chemical warfare agent, determining the concentration of such agent in short order is essential. Applicants recognized that the source of such problem was that current calibration systems lack the ability to simultaneously recognize and quantify isotopic analogs.

As a result of the aforementioned recognition, Applicants developed a calibration correction module that can be inserted into a mass spectrometer that improves such instrument's ability to provide timely, more precise and accurate data. Such module can easily be inserted into a mass spectrometer to correct the aforementioned deficiency. Such module has the additional benefit that real time, accurate mass determinations of low analyte quantity samples can be obtained.

SUMMARY OF THE INVENTION

The present invention relates to a method of improving a mass spectrometer, a module for improving a mass spectrometer and an improved mass spectrometer. The aforementioned method employs a calibration correction module that calibrates the mass spectrometer so timely, more precise and accurate data can be obtained. In particular, real time, accurate mass determinations of low analyte quantity samples can be obtained.

Additional objects, advantages, and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

DETAILED DESCRIPTION OF THE INVENTION

Definitions

Unless specifically stated otherwise, as used herein, the terms "a", "an" and "the" mean "at least one".

As used herein, the terms "include", "includes" and "including" are meant to be non-limiting.

Unless otherwise noted, all component or composition levels are in reference to the active portion of that component or composition, and are exclusive of impurities, for example, residual solvents or by-products, which may be present in commercially available sources of such components or compositions.

All percentages and ratios are calculated by weight unless otherwise indicated. All percentages and ratios are calculated based on the total composition unless otherwise indicated.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Correction Module and Improved Mass Spectrometer

For purposes of this specification, headings are not considered paragraphs and thus this paragraph is paragraph twelve of the present specification. The individual number of each paragraph above and below this paragraph can be determined by reference to this paragraph's number. In this paragraph twelve Applicants disclose a correction module programmed to:

a) take sensor responses for known quantities of one or more isotopes of a particular compound of interest and estimate the quantity of the compound of interest in a sample, by calculating the average of the relative response factors of the known quantities as an estimate of the relative response factor of the compound of interest; using the following equation, $$\frac{\sum_{i=1}^{n} \frac{y_i}{x_i}}{n} \cong x_0,$$

wherein $x_0$ is the quantity of compound of interest;

n=the total number of measurements taken in an analytic run;

$x_i$=the true amount of the ith isotope from an analytic run; and $y_i$=the ith sensor response value from an analytic run; then b) take sensor responses for known quantities of one or more isotopes of a particular compound of interest and estimate the quantity of the compound of interest in a sample, by calculating the values a and b which make the equation ay+b≅x true for all (x, y) pairs where x is the quantity of an isotope of the compound of interest included in the sample, and y is the sensor response for that same isotope; and/or c) use an intercept obtained during a previous analytic run combined with sensor responses for at least one known quantity of an isotope of a compound of interest to estimate the value of an unknown quantity of a compound of interest contained on the same sample, by using the equation ay+b=x to estimate a, where b is known from the previous analytic run, y is the sensor response for the known quantity of the isotope of the compound of interest, and x is the quantity of the isotope of the compound of interest by substituting for y the sensor response for the compound of interest into the equation ay+b thereby providing an estimate for the quantity of the compound of interest. a) is advantageous because it is simple and intuitive, and because it requires only one isotope. b) is advantageous because it allows for more accurate estimates, primarily for extremely small quantities. c) is advantageous because it allows field samples to be taken with only 1 isotope, and performs the primary calculation process as part of the initial calibration. This is important in part because the initial calibration can then be performed using the 1 available isotope and the compound itself. Otherwise, c) performs similarly to b), with increased error due to inter-machine and inter-sample variances.

Applicants disclose the correction module of Paragraph 12, said correction module comprising an input/output controller, a random access memory unit, a hard drive memory unit, and a unifying computer bus system, said input/output controller being configured to receive a digital signal and transmit said signal to said central processing unit and retrieve a signal comprising the accurate measurand from said central processing unit.

Applicants disclose a mass spectrometer comprising a correction module according to Paragraphs 0012 through 0013.

Applicants disclose mass a spectrometer according to Paragraph 0014 comprising a computer, said computer comprising said correction module.

Variables n=The total number of measurements taken in an analytic run.

$x_i$=The true amount of the ith isotope from an analytic run.

$y_i$=The ith sensor response value from an analytic run.

$x_{ic}$=The true amount of the ith isotope from an analytic run performed as part of a calibration $y_{ic}$=The ith sensor response value from an analytic run performed as part of a calibration.

$x_{if}$=The true amount of the ith isotope from an analytic run performed as part of a measurement in practice; i.e., in the field.

$y_{if}$=The ith sensor response value from an analytic run performed as part of a measurement in practice; i.e., in the field.

$ay_i+b$=The linear function approximating $x_i$, based upon $y_i$ and two given constants a and b. Note that b may be constrained to 0 in some methods.

Simple Approximation Method

The method may be applied to a sample containing an unknown quantity of the compound of interest and known quantities of one or more isotopes of the compound of interest. We begin with the assumption that all isotopes of the compound of interest and the compound of interest itself lie upon a line such that $$\frac{x_i}{y_i} \cong a.$$

First, the gas-chromatograph mass spectrometer sensor readings for the sample were taken. The average of the ratios $$\frac{x_i}{y_i}$$

for isotopes of the compound of interest which have known quantities were utilized as an estimate of the value a. Then we estimate the quantity of the compound of interest simply by dividing our estimate for a by the sensor response for the compound of interest. This method assumes that the line passing through the points $x_i$, $y_i$ on a coordinate plane also passes through zero. This is not exactly true, but is approximately true, with increasing accuracy for larger values of $x_i$. The following techniques will address cases where an estimate for the value of b is desirable.

Calibration Calculation

The preferred method for calibration calculation is to utilize a single sample containing unknown quantities of a compound of interest and at least two isotopes of the compound of interest. An analytic run is performed on a gas-chromatograph mass spectrometer, utilizing the sample above. This analytic run will return a series of sensor response values ($y_i$) corresponding to the known amount of the isotopes ($x_i$). At this point, several methods exist for calculating the calibration of the module. The calibration of the module may be calculated by assuming that the points collected lie approximately on a line ay+b=x for some unknown a and b, where x is the mass of a given isotope, and y is the average response factor (Rf) for that isotope. An effective method for estimating a and b is the method of least squares, detailed below. Once the estimates for a and b have been made, the quantity of the compound of interest can be estimated as ay+b, utilizing for y the sensor response corresponding to the compound of interest. It is possible to utilize the estimates for a and b on later samples containing unknown quantities of the compound of interest; however, utilizing estimates for a and b derived from other analytic samples will expose the estimate of the quantity of the compound of interest to the risk of bias. If this method is utilized, it is recommended that, when possible, an isotope of the compound of interest be included on the sample tube in known quantity, so that the bias may be estimated and partially corrected for. This is accomplished by utilizing the intercept from the previously performed analytic run, and utilizing the formula ay+b=x, with y being the sensor response for the isotope of the compound of interest, and x being the quantity of the isotope of the compound of interest, to estimate a—which can then be substituted into the equation ay+b, with y being the sensor response for the compound of interest, to estimate the quantity of the compound of interest.

Method of Least Squares

The method of least squares is a current technique for minimizing the sum of the squared errors for a formula of the form $(ay_i+b-x_i)^2$ for at least two $x_i$, $y_i$ pairs. It is calculated by taking $\Sigma_{i=1}^{n}(ay_i+b-x_i)^2$, and then taking the first derivative of that function with respect to a (this gives the first equation in a linear system), and with respect to b (this gives the second equation in the linear system), and then solving the resulting linear system for zero. Unfortunately such methodology is not applicable to multiple isotopes as the current software that is available cannot handle multiple isotopic data. Herein, Applicants provide a solution to such problem.

EXAMPLES

The following example illustrates particular properties and advantages of some of the embodiments of the present invention. Furthermore, these are examples of reduction to practice of the present invention and confirmation that the principles described in the present invention are therefore valid but should not be construed as in any way limiting the scope of the invention.

Example 1: A Calibration Module

As an example, a calibration correction module is assembled and programmed. The correction module is assembled by combining an analog to digital converter, an input/output controller, a random access memory unit, a central processing unit, a hard drive memory unit, and a unifying computer bus system. Signal is received via the analog-to-digital converter from an analytic sensor system, and the calibration is retrieved via the input/output controller. The correction module is programmed according to Paragraph 0012 using a programming language, such as, C++, Matlab, VBA, C#, or another coding language.

Example 2: An Instrument Comprising a Calibration Correction Module

In the instance of a gas-chromatograph mass spectrometer, the input received would be from both the gas-chromatograph and mass spectrometer, distinguishing individual chemical signatures and assessing the strength of signal based upon output from the mass spectrometer. Here, the instrument comprises a computer and the computer comprises the correction module of Example 1.

Example 3: Instrument Utilizing a Calibration Correction Module According to the Present Specification Vs. An Instrument not Utilizing a Calibration Correction Module—Field Example Using Isotopically Labeled Diethyl Malonate for Quantification of Unlabeled Diethyl Malonate (DEM)

In this example, three isotopic analogs of diethyl malonate, $x_{i1}$, $x_{i2}$ and $x_{i3}$, are pre-incorporated into the sample matrix and correspond to masses of 25 nanograms, 50 nanograms and 75 nanograms, respectively. 70 nanograms of the target analyte ($x_i$) is also incorporated onto the same sample matrix. Instrument response values for $y_i$, $y_{i1}$, $y_{i2}$ and $y_{i3}$ are experimentally determined to be 3765117, 1564336, 2575140 and 3974887 (arbitrary units), respectively. Application of equation defined in Paragraph 0018 yields an Rf of $1.6\times10^{-5}$, $1.9\times10^{-5}$ and $1.9\times10^{-5}$ respectively when it is assumed that b=0. Substitution of the average of these Rf values ($1.8\times10^{-5}$) back into the linear equation as a and analyzing the experimentally obtained value for $y_i$ (3765117) generates an $x_i$ value of 68 nanograms, or 97% of the loaded amount.

Example 4: Instrument Utilizing a Calibration Correction Module According to the Present Specification Vs. An Instrument not Utilizing a Calibration Correction Module—Field Example Using Isotopically Labeled DEM for Quantification of an Unspecified G-Agent In this example, three isotopic analogs [of the target analyte], $x_{i1}$, $x_{i2}$ and $x_{i3}$, are pre-incorporated into a thermal desorption (TD) tube and correspond to masses of 25 nanograms, 50 nanograms and 75 nanograms, respectively. The TD tube is transported to a remote location for field sampling. An unknown amount of the target analyte ($x_i$) is collected onto the same sample matrix. Prior laboratory analysis of instrument responses to DEM and the G-agent yielded an average RRf of 0.675, derived by calculating the ratio of the G-agent response factor to that of DEM. Instrument response values for $y_{i1}$, $y_{i2}$ and $y_{i3}$ are experimentally determined to be 2122557, 1725997, 2675140 and 4023495 (arbitrary units), respectively. Application of equation defined in Paragraph 0018 yields an Rf value of $1.5\times10^{-5}$, $1.9\times10^{-5}$ and $1.9\times10^{-5}$ respectively when it is assumed that b=0. Substitution of the average of these Rf values ($1.8\times10^{-5}$) back into the linear equation as a and analyzing the experimentally obtained value for $y_i$ (2122557) generates an $x_i$ value of 38.0 nanograms that is then divided by the RRf value to correct for differential response of the instrument to the DEM isotopic analogs and the G-agent, yielding a value of 56.3 nanograms.

What is claimed is:

1. A mass spectrometer comprising a correction module, said correction module comprising an input/output controller, a random access memory unit, a hard drive memory unit, and a unifying computer bus system, said input/output controller being configured to receive a digital signal and transmit said signal to said central processing unit and retrieve a signal comprising the accurate measurand from said central processing unit, said correction module programmed to:

a) take sensor responses for known quantities of one or more isotopes of a particular compound of interest and estimate the quantity of the compound of interest in a sample, by calculating the average of the relative response factors of the known quantities as an estimate of the relative response factor of the compound of interest; using the following equation, $$\frac{\sum_{i=1}^{n}\frac{y_i}{x_i}}{n} \cong x_0,$$

wherein $x_0$ is the quantity of compound of interest;

n=the total number of measurements taken in an analytic run;

$x_i$=the true amount of the ith isotope from an analytic run; and $y_i$=the ith sensor response value from an analytic run; then b) take sensor responses for known quantities of one or more isotopes of a particular compound of interest and estimate the quantity of the compound of interest in a sample, by calculating the values a and b which make the equation ay+b≅x true for all (x, y) pairs where x is the quantity of an isotope of the compound of interest included in the sample, and y is the sensor response for that same isotope; and/or c) use an intercept obtained during a previous analytic run combined with sensor responses for at least one known quantity of an isotope of a compound of interest to estimate the value of an unknown quantity of a compound of interest contained on the same sample, by using the equation ay+b=x to estimate a, where b is known from the previous analytic run, y is the sensor response for the known quantity of the isotope of the compound of interest, and x is the quantity of the isotope of the compound of interest by substituting for y the sensor response for the compound of interest into the equation ay+b thereby providing an estimate for the quantity of the compound of interest.

2. The mass spectrometer according to claim 1 comprising a computer, said computer comprising said correction module.

* * * * *